US006886714B2

(12) United States Patent
Kruchoski et al.

(10) Patent No.: US 6,886,714 B2
(45) Date of Patent: May 3, 2005

(54) CONTAINER ALLOWING CHOICE OF MULTIPLE OPENINGS FOR DISPENSING PREFERENCE

(75) Inventors: Benjamin J. Kruchoski, Appleton, WI (US); Pamela M. Thompson, Neenah, WI (US); Daphne L. VanBuren, Greenville, WI (US); Chantel S. Buhrow, Weyauwega, WI (US); John C. Zigament, Sherwood, WI (US); Bozena Nogai, Appleton, WI (US); Ginger Glomstead, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 125 days.

(21) Appl. No.: 10/215,373

(22) Filed: Aug. 8, 2002

(65) Prior Publication Data

US 2004/0026440 A1 Feb. 12, 2004

(51) Int. Cl.[7] ..... B65H 1/00
(52) U.S. Cl. ..... 221/48; 221/302
(58) Field of Search ..... 206/233; 221/47, 221/48, 68, 302, 34, 32, 63

(56) References Cited

U.S. PATENT DOCUMENTS

| | | | | | |
|---|---|---|---|---|---|
| 3,145,840 | A | * | 8/1964 | Wright | 206/494 |
| 3,272,385 | A | | 9/1966 | Watkins | |
| 3,325,003 | A | * | 6/1967 | Bilezerian | 206/494 |
| 4,623,074 | A | | 11/1986 | Dearwester | |
| 5,415,320 | A | * | 5/1995 | North et al. | 221/63 |
| 5,613,608 | A | * | 3/1997 | Tronchetti et al. | 206/494 |
| 5,622,281 | A | * | 4/1997 | Annand | 221/48 |
| 6,053,357 | A | * | 4/2000 | Yoh | 221/63 |
| 6,296,143 | B1 | * | 10/2001 | Ghabriel | 221/34 |
| 6,349,849 | B1 | * | 2/2002 | Pehr | 221/33 |
| 6,523,690 | B1 | * | 2/2003 | Buck et al. | 206/494 |
| 6,571,985 | B2 | * | 6/2003 | Wilkes et al. | 221/63 |
| 6,585,131 | B2 | * | 7/2003 | Huang et al. | 221/48 |
| 6,648,172 | B2 | * | 11/2003 | Leighton et al. | 221/35 |
| 6,702,147 | B2 | * | 3/2004 | Ashford | 221/34 |
| 2002/0079322 | A1 | | 6/2002 | Wilkes et al. | |
| 2003/0094461 | A1 | * | 5/2003 | Knol | 221/63 |
| 2003/0136793 | A1 | * | 7/2003 | Chen | 221/63 |
| 2003/0226851 | A1 | * | 12/2003 | Antebi | 221/47 |

FOREIGN PATENT DOCUMENTS

EP 1120360 8/2001

OTHER PUBLICATIONS

U.S. Appl. No. 10/015,512, filed Dec. 13, 2001.
PCT Search Report mail date Nov. 26, 2003.

* cited by examiner

*Primary Examiner*—Donald P. Walsh
*Assistant Examiner*—Matthew J. Kohner
(74) *Attorney, Agent, or Firm*—Dority & Manning, P.A.

(57) ABSTRACT

A dispensing container for dispensing sheets is provided in which the container has a first dispensing opening for pop-up dispensing of sheets such as facial tissue. The container has a second opening to provide group dispensing of a plurality of sheets simultaneously without having to disassociate the sheets from each other. The openings can be overlayed on each other, or one opening can be placed on one portion of the container and another opening on another portion of the container to provide a consumer with various dispensing options.

53 Claims, 3 Drawing Sheets

CONTAINER ALLOWING CHOICE OF MULTIPLE OPENINGS FOR DISPENSING PREFERENCE

BACKGROUND OF THE INVENTION

Disposable sheet style dispensers are well-known in the art for dispensing individual folded sheet products such as facial tissues, hand sheets, wet wipes, or the like. Disposable sheets include single or multi-use (i.e. semi-durable) sheets with a short lifespan that are not considered durable over an extended number of uses.

In general, disposable sheet dispensers typically include a container with a stack or clip of pre-folded sheets disposed within the container. The sheets may be c-folded, v-folded, interfolded, multi-folded, or flat so that once the top sheet in the clip is withdrawn, the underlying sheet is individually presented for subsequent use.

Pop-up and reach-in dispensing style containers or cartons are the two principle types of cartons used for dispensing folded sheet products. Pop-up type dispensing cartons permit the sheets to be dispensed through an opening, such as in a top wall of the carton, to allow partial withdrawal of the next successive sheet upon pulling sheets one at a time from the carton. Reach-in dispensing cartons permit removal of one or more sheets at one time. A third type of carton is disclosed, for example, in U.S. Pat. No. 4,623,074, which provides for simultaneous pop-up dispensing of one sheet at a time as well as dispensing of a plurality of sheets as a group.

At least one drawback with contemporary dispensing cartons is that a consumer can only open the carton in one way. Whether the consumer purchases the pop-up or reach-in type dispenser or the type disclosed in U.S. Pat. No. 4,623,074, a choice of openings is not offered. Also, the latter two types expose the sheets to the environment at all times whether desired or not.

SUMMARY OF THE INVENTION

In general, the present invention is directed to a carton or dispenser, which provides a consumer with a choice of dispensing openings to withdraw sheets from the carton as a group or one after another. The openings can be overlayed on each other, for instance, on top of the carton, or by way of further example, one opening can be placed on the top for pop-up dispensing and another opening can be placed on a bottom of the carton for dispensing sheets as a group. The sheets may be individually folded sheet products such as facial tissues, hand sheets, wet wipes, or the like.

In one aspect of the invention the openings are overlayed on each other on the top of the carton. A micro-perforated polymer cover is adhered to an inner side of the carton and is adapted to tear and open when a removable panel is removed in selecting a reach-in style opening. Alternatively, if a pop-up dispensing style is first selected in the overlayed arrangement, the polymer cover is pierced and the removable panel stays substantially intact to provide a pop-up dispensing style. If the pop-up style is selected first, the consumer may subsequently select the reach-in style and the micro-perforated polymer cover will tear away to provide the reach-in style opening.

In an alternative embodiment, the micro-perforated polymer cover is disposed on one part of the carton to provide the pop-up style dispensing. A removable panel is disposed away from the polymer cover on another part of the carton to accommodate a reach-in style opening. This aspect provides the consumer with the flexibility to choose either or both dispensing styles at once.

The inventive dispenser can be made from various materials, such as paperboard or cartonboard for the dispenser and a flexible polymer film for the micro-perforated cover. Also, the dispenser can be shaped as a rectangular box, a square box, or any shape desired by the consumer, marketing, or by manufacturing constraints.

Other aspects and features of the invention will be apparent from the following description and the attached drawings, or can be learned through practice of the invention.

BRIEF DESCRIPTION OF THE DRAWINGS

The above and other aspects of the present invention are apparent from the detailed description below and in combination with the drawings in which.

DETAILED DESCRIPTION OF THE DRAWINGS

Figure 1:
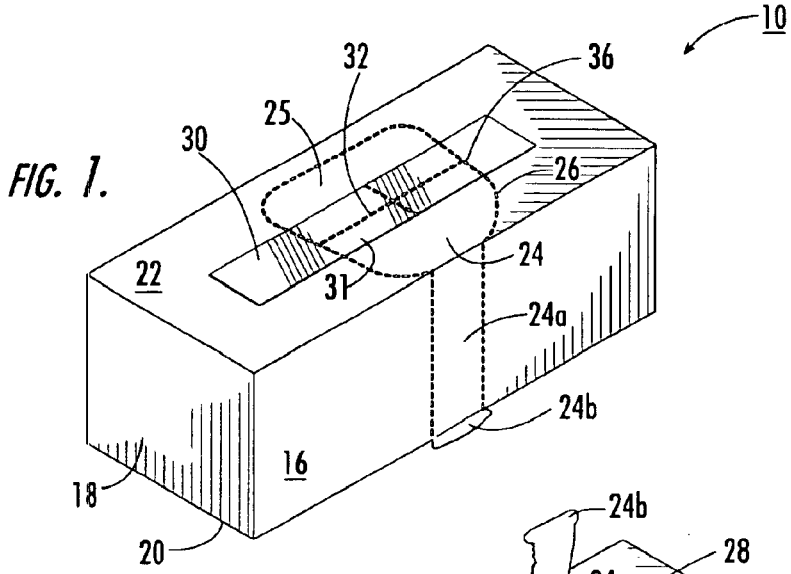
FIG. 1 is a perspective view of one embodiment of the present invention.

Detailed reference will now be made to the drawings in which examples embodying the present invention are shown. Repeat use of reference characters in the present specification and drawings is intended to represent same or analogous features or elements of the invention.

The drawings and detailed description provide a full and detailed written description of the invention and the manner and process of making and using it, so as to enable one skilled in the pertinent art to make and use it. The drawings and detailed description also provide the best mode of carrying out the invention. However, the examples set forth herein are provided by way of explanation of the invention and are not meant as limitations of the invention. The present invention thus includes modifications and variations of the following examples as come within the scope of the appended claims and their equivalents.

In general the present invention is directed to a dispensing container, which includes a perforated portion or a removable panel that uncovers an opening or dispensing aperture for a consumer to withdraw the sheets in groups or one at a time. In addition to the perforated portion or removable panel, the invention includes a micro-perforated polymer or plastic cover, or film, located on the dispensing container, which may be covered by a second removable panel that provides an alternative opening for dispensing sheets singularly. Together, the removable panel and cover provide the consumer a choice of both pop-up and reach-in styles to dispense disposable sheets such as facial tissues, paper towels, industrial wipers, laboratory wipers, wet wipes, and the like. More specifically, a sheet may be defined as a paper, a tissue, a non-woven polymer material, an airlaid material and the like and be wet, dry, or treated sheets.

As broadly embodied in the Figures, a carton, container, or dispenser 10 for dispensing disposable sheets is provided in accordance with the present invention. The dispensing container 10 is for housing facial tissue in accordance with one embodiment of the present invention. It should be understood, however, that various other disposable sheets can be contained in a container made in accordance with the present invention.

Figure 2:
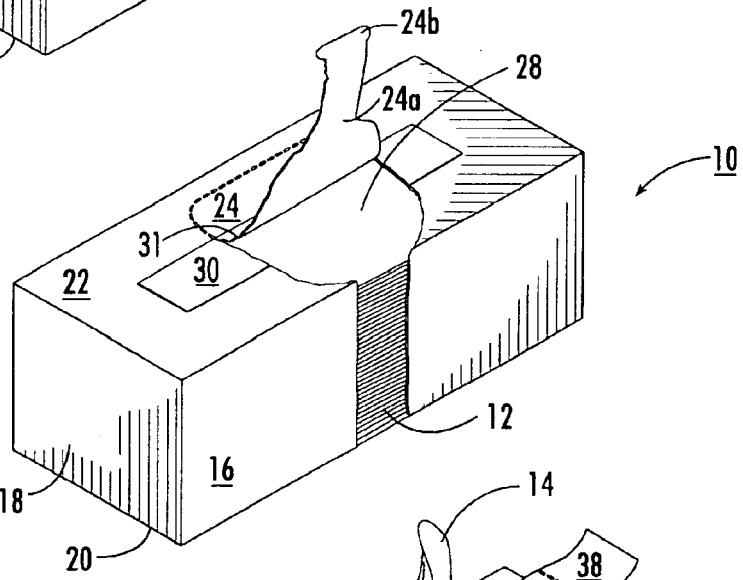
FIG. 2 shows the embodiment of FIG. 1 in which a reach-in style opening according to an aspect of the invention has been selected.
Figure 3:
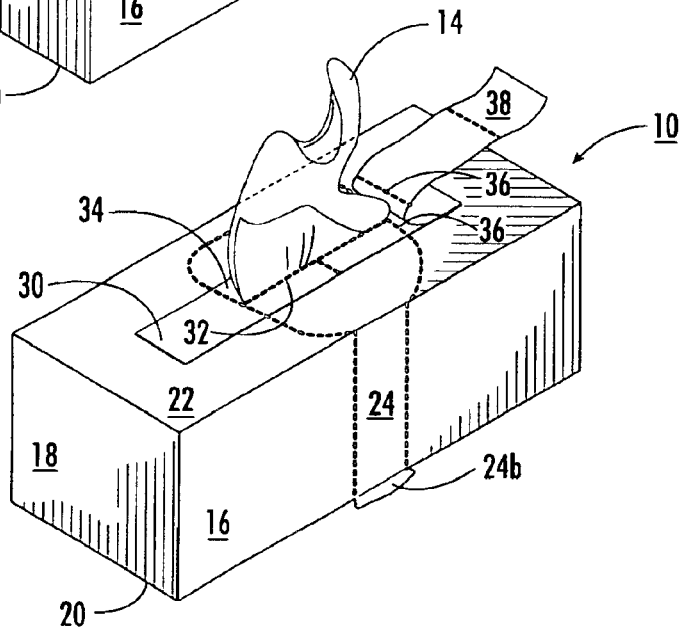
FIG. 3 shows the embodiment of FIG. 1 in which a pop-up dispensing style has been selected in accordance with another aspect of the invention.

Referring to FIGS. 1, 2 and 3, the dispensing container 10 contains a clip of disposable sheets 12. The clip of disposable sheets 12, as shown particularly in FIG. 2, may be c-folded, v-folded, interfolded, multi-folded, or variously configured with respect to one another as commonly known in the art. Specifically, the clip of sheets 12 may be multi-folded, perforated, and/or mechanically, chemically, thermally, and/or ultrasonically attached to one another to allow singular dispensing by the consumer with minimal effort.

FIG. 1 shows the dispensing container 10 with a pair of sides or walls 16 that are contiguous with another pair of sides or walls 18. A support side or bottom 20 contacts the walls 16 and 18. The clip of sheets 12 contained within the container 10 generally rest upon the bottom 20 in this embodiment.

FIG. 1, for example, shows the dispensing container 10 in the shape of a rectangular box. However, dispensing container 10 may be in the shape of a square box or any other suitable shape dictated by consumer, marketing, or manufacturing requirements. For instance, the dispensing container 10 may be shaped as an oval, a cylinder, a triangle, an irregular shape or any consumer-preferred shape.

The dispensing container 10 of the invention can be made from various materials such as wood, paper, metal, cloth, ceramic plastic, polymers or the like. For instance, the container 10 can be made from paperboard, cartonboard, or cardboard and include plastic films, such as thermoplastic film. The paperboard used, for instance, to form the walls 16, 18, and bottom 20 of the container 10 can be rigid or flexible, while the film may flexibly form a cover 30, discussed below.

Contiguous with the walls 16, 18 is a dispensing wall or top wall 22. The top wall 22 includes a removable or tear-out panel 24. Removable panel 24 defines a neck or stem 24*a* which terminates in a tab 24*b* and is separable from the dispensing container 10 by perforations 26. In this arrangement, a user or consumer is able to grasp the end tab 24*b* and pull the neck 24*a* along the perforations 26 and a third set of overlap perforations 36 to remove the removable panel 24 for reach-in style access to the stack of tissues 12. Although panel 24 is shown with neck 24*a* and tab 24*b*, the panel 24 can be configured for removal in various ways and need not have the neck 24*a* and tab 24*b* as illustrated. For instance, panel 24 may be in the shape of an inverted triangle in which a point of the triangle is lifted by the consumer to initiate removal of the panel 24. Moreover, panel 24 may extend across an entirety of the top wall 22 and portions of the walls 16, 18; across only the top wall 22; across only the walls 16 or 18; or in any other combination as desired.

The film 30 shown in FIG. 2 is attached, for example, to an interior (not shown) of the top wall 22 via an adhesive or other attachment method or mechanism. In this aspect, the film 30 is configured to be selectively perforated or opened for pop-up dispensing of a tissue 14 from the clip 12, which is discussed in greater detail below. It is to be noted that the film 30 can be any material, such as a non-woven polymer, plastic, fiberboard, cardboard, rubber, metal, silk, cloth, tissue, paper or the like to allow substantially droop-free pop-up dispensing of any product such as a polymer product, a tissue paper product, a non-woven product and the like as mentioned above.

In one aspect of the invention, a micro-perforated or perforated portion 31 overlaps a portion of the removable panel 24 and a portion of the film 30. The overlap portion 31 may be removed via a third set of overlap perforations 36 when the perforated removable panel 24 is removed for access to the clip of sheets 12. Accordingly, when the reach-in style opening as seen in FIG. 2 is selected by the consumer, at least one or more of the sheets of the clip 12 can be withdrawn through a first opening 28 without having to disassociate groups of sheets 12 from each other. It is to be noted that alternatively or in addition to using overlap perforations 36, portion 31 can be removably attached to film 30 by an adhesive, ultrasonic bonds, or the like and be within the scope of the invention.

If removable panel 24 is not removed, as shown in FIG. 3, the consumer can alternatively and selectively pierce or open the overlapping portion 31 of film 30 via a second set of overlap perforations 32 to open a second opening or aperture 34 in order to dispense the single tissue 14 in substantially droop-free, pop-up style dispensing. In this aspect, the second set of overlap perforations 32 are perforatingly disposed on the film 30 in an X- or slit-shaped pattern to permit selective piercing by the consumer to access the single tissue sheet 14. (See also FIG. 1.) The X-pattern in particular may be formed by four substantially unconnected triangle shaped pieces of film proximate each other. Notably, any pattern of the second set of overlap perforations 32 is contemplated by the invention, such as an oval pattern, a wave-pattern, an I pattern, a double Y-pattern, a V-pattern, a triangle, a parallelogram, a pentagon, a hexagon, a circular pattern or any combinations of these and other patterns. It is also to be noted that perforations 32 may be substituted with an opening 332 formed by overlaying or abutting two or more pieces of film 330*a*, 330*b*, discussed with reference to FIG. 7 in greater detail below.

Should the consumer select the single sheet pop-up dispensing style, FIG. 3 shows that the overlapping removable panel 24 remains substantially intact as the second set of overlap perforations 32 are pierced or opened in the film 30 for pop-up style dispensing. Advantageously, should the consumer subsequently change preferences after selecting the pop-up style dispensing, the panel 24 can still be later removed as previously described. FIG. 3 also shows that an additional removable panel 38 can be removably attached to cover at least the micro-perforated/perforated portion 31 for aesthetic or protective purposes. Therefore, if the consumer chooses the pop-up style, the additional protective panel 38 is first removed before selectively piercing the second set of overlap perforations 32. Moreover, it is to be noted that an overlapping portion 31 can be pre-slit rather than perforated if the additional panel 38 is provided.

Although removable panel 24 is shown overlapping film 30 on the top wall 22 of dispensing container 10, panel 24 and film 30 can be overlapped in various other arrangements and disposed on other areas of the dispensing container 10 such as on the wall 18 as introduced above. For instance, the film 30 can terminate at the third set of overlap perforations 36 such that the removable panel 24, when removed, completely removes film 30. (Compare film 330*a*, 330*b* in FIG. 7.)

Figure 4:
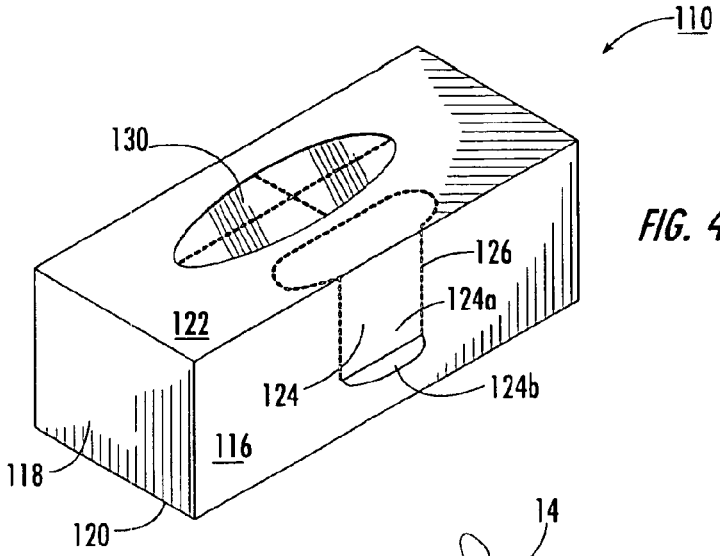
FIG. 4 is another embodiment in accordance with the present invention.
Figure 5:
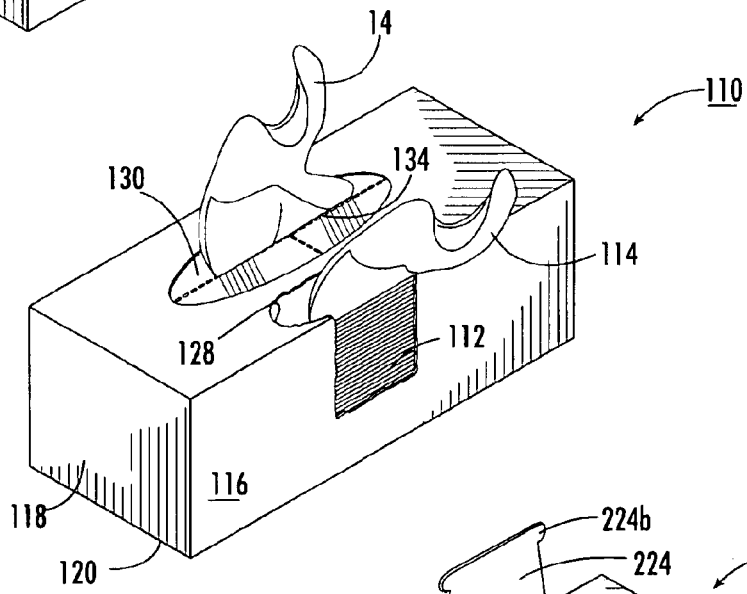
FIG. 5 shows the embodiment of FIG. 4 in which both reach-in and pop-up dispensing styles have been selected.

With reference to FIGS. 4 and 5, another embodiment contemplated by the present invention is shown. In this aspect, in some ways similar to the foregoing embodiment, a dispensing container 110 is provided with a tear-out or removable panel 124 and a polymer film cover 130. The panel 124 and cover 130 are arranged for selectively dispensing the clip of disposable sheets 112 through the first dispensing opening 128 or through the second dispensing opening 134. For illustration purposes, the removable panel 124 and perforated polymer film cover 130 are shown in this embodiment disposed on wall 116 and top wall 122 of the dispensing container 110. However, the invention contemplates that panel 124 and cover 130 can be spaced further apart. For instance, panel 124 could be located as shown in FIG. 4 while the polymer cover 130 could be located on the bottom 120 or wall 118 of the dispensing container 110.

With more particular reference to FIG. 4, the removable panel 124 in this aspect can be selectively removed to uncover the first dispensing opening 128 for withdrawing one or more sheets from the clip 112 without having to disassociate them from each other, or, of course, a single sheet 114 could be selected via the first dispensing opening 128. The perforated cover 130 in this aspect is configured to be selectively pierced to open the second dispensing opening 134 to permit substantially droop-free pop-up dispensing of one sheet 114 at a time.

As previously introduced, the clip of disposable sheets 112 can be facial tissues, paper towels, industrial wipers, laboratory wipers, wet wipes, and the like. Further, the dispensing container 110 can be in the shape of a rectangle, square or consumer-preferred shape and be made of cartonboard, cardboard or paperboard or flexible or rigid material or the like and remain in the scope of the invention.

Figure 6:
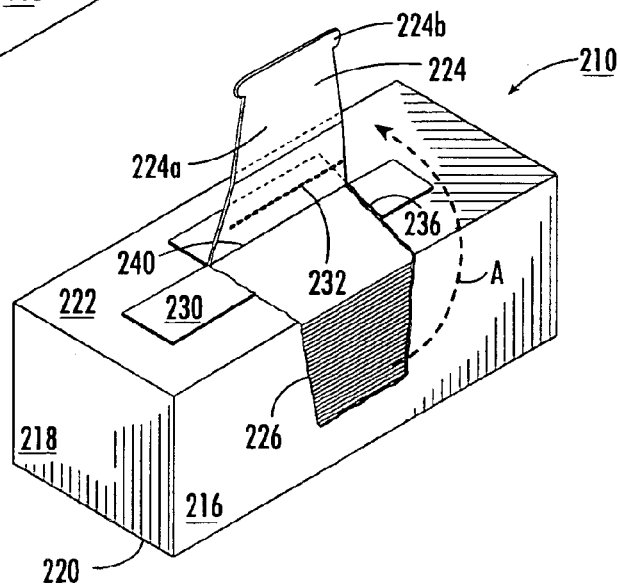
FIG. 6 shows a further embodiment according to an aspect of the invention.

FIG. 6 shows a dispensing container 210, which is in some ways similar to the foregoing embodiments. In this aspect of the invention, a selectable or partially removable panel 224 is disposed on the dispensing container 210 via a first set of perforations 226 proximate a pop-up sheet dispensing film 230, which is co-located, for example, on a portion of the selectable panel 224. Defined on the film 230 is a second set of perforations 232 that can be selectively pierced or opened by the consumer for pop-up dispensing of a tissue 14 (not shown in FIG. 6 for clarity). As previously described, the dispensing film 230 can be a polymer or other suitable material and may be perforated by a third set of overlap perforations 236 to accommodate partial removal by the selectable or partially removable panel 224.

The selectable panel 224 is shown in FIG. 6 hingably connected to the dispensing container 210 via a hinge 240, which permits the selectable panel 224 to be folded away from a top surface 222, wall 218 or other portion of the dispensing container 210 for selective removal of a plurality of sheets. The selectable panel 224 may also be hinged via hinge 240 such that the entirety of top surface 222 and one of the side walls 218 or 216 are able to be opened. Hinge 240 is illustrated scored or notched transversely on the selectable panel 224 to permit the consumer to grasp and pull a portion of the selectable panel 224 away from the wall 216 and top surface 222 via the first set of perforations 226 and the third set of overlap perforations 236 in a direction indicated by arrow A. Of course, hinge 240 can be oriented in various other directions other than as shown and may be disposed such that overlap perforations 236 are not required; i.e., hinge 240 could be located proximate a portion of the dispensing film 230 in a direction of wall 216 so that no part of dispensing film 230 is affected by the operation of the selectable panel 224. Further, any suitable bend, joint, or mechanical hinge apparatus may be used for hinge 240 and be within the scope of the invention.

By way of example operation, FIG. 6 shows the partially removable panel 224 (in phantom) selectively folded away from the top surface 222. The partially removable panel 224 is further configured to be selectively re-folded towards the top surface 222 in a reverse direction of arrow A for successive operations of the selectable panel 224. Thus, in this aspect of the invention, the consumer has the option of selectively piercing the second set of perforations 232 for pop-up style dispensing, selectively opening the dispensing container 210 via partially removable panel 224 for reach-in style dispensing as previously described, and/or re-folding the panel 224 toward the top surface 222 for subsequent pop-up style dispensing via the second set of perforations 232.

Figure 7:
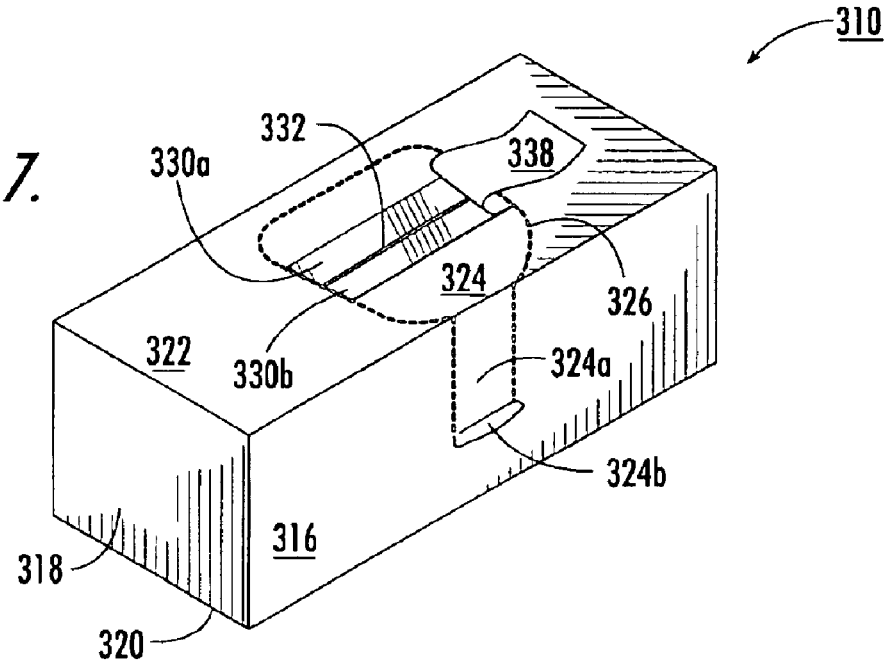
FIG. 7 shows an additional embodiment according to another aspect of the invention.

FIG. 7 illustrates another aspect of the invention in which a dispensing container 310 has the abutting or layered opening 332, briefly introduced above. Opening 332 is formed by abutting or overlaying the two or more films 330*a*, 330*b*, which may be a polymer or similarly flexible material to permit the consumer to pop-up individual sheets (not shown).

As seen in FIG. 7, the films 330*a*, 330*b* may be substantially rectangular shaped in which three of four sides are adhered to the underside (not shown) of top wall 322 in a conventional manner. The remaining free edges of each film 330*a*, 330*b* are disposed proximate each other to form the opening 332. The free edges may abut each other as seen in FIG. 7, or they may overlap to some degree to form a flap-type arrangement if desired.

Although the films 330*a*, 330*b* are illustrated as rectangular shapes, they may be any desired shape such as triangular, circular, and the like. Moreover, the orientation of opening 332 may be other than as shown, such as perpendicular or diagonal in relation to the example shown and multiple openings 332 may be provided.

In another aspect, FIG. 7 shows that a neck or stem 324*a* of a panel 324 is separable from the dispensing container 310 by perforations 326. In contrast to the embodiment of FIG. 1, for instance, the neck 324*a* is shorter than neck 24*b* previously discussed. Stated alternatively, a tab 324*b* in FIG. 7 is disposed at a midpoint on a wall 316 in contrast to the position of tab 24*b* in FIG. 1.

FIG. 7 illustrates another removable covering panel 338, similar to the panel 38 seen in FIG. 3, which is provided to removably cover films 330*a*, 330*b*. By comparison, the covering panel 338 is shorter than the panel 38 since films 330*a*, 330*b* are somewhat shorter than film 30. In this example, films 330*a*, 330*b* do not extend past panel 324 to the top wall 322.

Also in this aspect, the removable panel 324 may be hingably connected to the top wall 322, similar to the arrangement shown in FIG. 6, such that the panel 324 is partially removable for selectively folding away from the top surface 322. Likewise, the removable panel 324 can be further configured to be selectively re-folded towards the top surface 322 for successive operations of the selectable panel 324.

Those of ordinary skill in the art will appreciate that the foregoing descriptions are by way of example only, and are not intended to limit the invention as further described in the appended claims. Thus, it will be apparent to those skilled in the art that various modifications and variations can be made in the present invention without departing from the scope and spirit of the invention. For example, specific shapes, quantities, and arrangements of various elements of the illustrated embodiments may be altered to suit particular applications. Moreover, various embodiments may be interchanged both in whole or in part, and it is intended that the present invention include such modifications and variations as come within the scope of the appended claims and their equivalents.

That which is claimed is:

1. A container for dispensing disposable sheets comprising:

a dispensing container housing a clip of disposable sheets for selectively dispensing at least one of the sheets through a first dispensing opening or through a second dispensing opening, the dispensing container including a removable panel and a cover, the cover disposed on a least a portion of the removable panel, the removable panel configured for selective opening to uncover the first dispensing opening for withdrawing at least one of the sheets and further configured for selective closing to access the cover, the cover configured to be pierced and retained on the portion of the removable panel to open the second dispensing opening for substantially droop-free, pop-up dispensing of one sheet at a time.

2. The container as defined in claim 1, wherein the clip of disposable sheets is selected from the group consisting of a tissue, a non-woven polymer material, an airlaid material, and a paper material.

3. The container as defined in claim 2, wherein the clip of disposable sheets is selected from the group consisting of wet sheets, dry sheets, and treated sheets.

4. The container as defined in claim 1, wherein the dispensing container is a rectangular shape.

5. The container as defined in claim 1, wherein a shape of the dispensing container is selected from the group consisting of a square, a cylinder, a substantially oval shape, and a triangle.

6. The container as defined in claim 1, wherein the removable panel is surrounded by a first set of perforations that attach the removable panel to the dispensing container and wherein a second set of perforations are defined on the cover.

7. The container as defined in claim 6, wherein the removable panel remains substantially intact when the second set of perforations are pierced for pop-up dispensing of one sheet at a time via the perforated cover.

8. The container as defined in claim 6, wherein at least a portion of the removable panel and at least a portion of the cover overlap each other such that the first set of perforations cross the cover to form a third set of perforations.

9. The container as defined in claim 8, wherein the removable panel, when opened, removes at least a portion of the cover via the third set of perforations.

10. The container as defined in claim 1, wherein the removable panel is hingably connected to the dispensing container and configured to be selectively folded away from the first dispensing opening for withdrawing at least one of the sheets and further configured to be selectively folded towards the first dispensing opening to close the first dispensing opening.

11. The container as defined in claim 1, wherein the removable panel is surrounded by a first set of perforations that attach the removable panel to the dispensing container and wherein an overlapping layered opening defines the cover.

12. The container as defined in claim 11, wherein the overlapping layered opening is formed by at least two pieces of film, the two pieces of film attached to the dispensing container proximate each other.

13. The container as defined in claim 1, wherein the dispensing container is selected from the group consisting of cartonboard, cardboard, paperboard, plastic, polymers, wood, metal, cloth, and ceramic.

14. The container as defined in claim 1, further comprising a protective panel removably disposed about the cover.

15. The container as defined in claim 14, wherein the removable and protective panels are selected from the group consisting of cartonboard, cardboard, paperboard, plastic, polymers, wood, metal, cloth, and ceramic.

16. The container as defined in claim 1, wherein the cover is selected from the group consisting of a flexible polymer, a non-woven polymer, a plastic, a rubber, a tissue, a silk, a cloth, a paper, and a paperboard.

17. A dispenser for dispensing disposable sheets comprising:

a dispensing container for selectively dispensing disposable sheets through a first dispensing opening or through a second dispensing opening, the dispensing container including a removable panel and a cover spaced apart from each other, the removable panel configured for selective removal to uncover the first dispensing opening for withdrawing at least one sheet without having to dissociate a plurality of sheets from each other, the cover configured to provide the second dispensing opening for substantially droop-free pop-up dispensing of one sheet at a time; and a protective panel disposed about the cover to at least temporarily protect the cover until the protective panel is removed for pop-up dispensing of the disposable sheets via the cover.

18. The dispenser as defined in claim 17, wherein the disposable sheets are selected from the group consisting of a tissue, a non-woven polymer material, an airlaid material, and a paper material.

19. The dispenser as defined in claim 17, wherein the disposable sheets are selected from the group consisting of wet sheets, dry sheets, and treated sheets.

20. The dispenser as defined in claim 17, wherein the dispensing container is selected from the group consisting of paperboard, cardboard, cartonboard, plastic, polymers, wood, metal, cloth, and ceramic.

21. The dispenser as defined in claim 17, wherein the removable panel is selected from the group consisting of paperboard, cartonboard, cardboard, plastic, polymers, wood, metal, cloth, and ceramic.

22. The dispenser as defined in claim 17, wherein the removable panel is surrounded by a first set of perforations that attach the removable panel to the dispensing container and wherein overlapping films define the cover.

23. The dispenser as defined in claim 17, wherein a shape of the dispensing container is selected from the group consisting of a square, a cylinder, a substantially oval shape, and a triangle.

24. The dispenser as defined in claim 17, wherein the dispensing container is a rectangle shape.

25. The dispenser as defined in claim 17, wherein the removable panel is surrounded by a first set of perforations that attach the removable panel to the dispensing container spaced apart from the cover.

26. The dispenser as defined in claim 17, wherein the removable panel, when removed, does not affect the cover.

27. The dispenser as defined in claim 17, wherein a second set of perforations are defined on the cover.

28. The dispenser as defined in claim 27, wherein the second set of perforations when opened for pop-up dispensing of one sheet at a time does not remove the removable panel.

29. A method for making a dispensing container configured for selectively dispensing disposable sheets therefrom, the method comprising the steps of:

providing a material adapted to form a dispensing container for housing a clip of disposable sheets;

attaching a flexible cover to the material;

micro-perforating at least a portion of the flexible cover with a die for removal of the portion in a reach-in dispensing style;

forming a removable panel on the material such that at least a portion of the flexible cover is formed across the removable panel, the removable panel configured for selective removal to uncover a first dispensing opening for withdrawing at least one or more sheets without having to dissociate them from each other; and at least partially opening the flexible cover in a pop-up dispensing style, the flexible cover configured to provide a second dispensing opening for substantially droop-free pop-up dispensing of one sheet at a time when the pop-up dispensing style is selected.

30. The method as defined in claim 29, further comprising the step of forming the material into the dispensing container.

31. The method as defined in claim 30, wherein the material is plastic and the steps of forming the removable panel and the dispensing container is by molding.

32. The method as defined in clam 29, wherein the material is selected from the group consisting of paperboard, cardboard, cartonboard, plastic, polymer, wood, metal, and cloth, ceramic.

33. The method as defined in claim 29, wherein the flexible cover is made from a polymer film.

34. The method as defined in claim 29, wherein the flexible cover is at least partially opened in the pop-up dispensing style in a pattern selected from the group consisting of an X-pattern, a slit pattern, an oval pattern, a wave-pattern, a circular pattern, an I-pattern, a double Y-pattern, a V-pattern, a triangle, a parallelogram, a pentagon, and a hexagon.

35. The method as defined in claim 34, wherein the flexible cover is at least partially opened by perforating the pattern.

36. The method as defined in claim 34, wherein the flexible cover is at least partially opened in the pop-up dispensing style by slitting the X-pattern such that the X-pattern forms four substantially unconnected triangle shapes.

37. The method as defined in claim 34, wherein the flexible cover is at least partially opened in the pop-up dispensing style by slitting the pattern.

38. The method as defined in claim 34, further comprising a protective panel disposed on the cover to at least temporarily protect the cover until the protective panel is removed for pop-up dispensing via the cover.

39. A dual mode dispensing container for selectively dispensing disposable sheets from dual openings made by the process comprising the steps of:

providing a dispensing container for housing a clip of disposable sheets;

perforating the dispensing container with a die in a reach-in dispensing style to form a removable panel, the removable panel configured for selective removal to uncover a first dispensing opening for withdrawing at least one or more sheets without having to dissociate them from each other;

attaching a flexible cover to the dispensing container, the flexible cover disposed apart from the removable panel; and at least partially opening the flexible cover in a pop-up dispensing style, the flexible cover configured to be selectively opened to open a second dispensing opening for substantially droop-free, pop-up dispensing of one sheet at a time when the pop-up dispensing style is selected.

40. The process as defined in claim 39, wherein the dispensing container is selected from the group consisting of cartonboard, cardboard, paperboard, plastic, polymers, wood, metal, cloth, and ceramic.

41. The process as defined in claim 39, wherein the removable panel is selected from the group consisting of cartonboard, cardboard, plastic, polymers, wood, metal, cloth, and ceramic.

42. The process as defined in claim 39, wherein the flexible cover is selected from the group consisting of a polymer, a non-woven polymer, a plastic, a rubber, a tissue, a silk, a cloth, a paper, and a cartonboard.

43. The process as defined in claim 39, wherein the flexible cover is attached to the inner side of the dispensing container by an adhesive.

44. The process as defined in claim 39, wherein the flexible cover is perforated with a die in the pop-up dispensing style in an X-pattern.

45. The process as defined in claim 39, wherein the flexible cover is opened in the pop-up dispensing style in a slit-shape.

46. The process as defined in claim 39, wherein the removable panel is surrounded by a first set of perforations that attach the removable panel to the dispensers.

47. The process as defined in claim 39, wherein an overlapping layered opening defines the cover, the overlapping layered opening formed by at least two pieces of film, the two pieces of film attached to the dispenser proximate each other.

48. An apparatus for dispensing disposable sheets comprising:

a dispensing container for selectively dispensing disposable sheets through a first dispensing opening and through a second dispensing opening, the dispensing container including a selectable panel and a cover disposed about the selectable panel, the selectable panel hingably connected to the dispensing container and configured to be selectively folded away from the first dispensing opening such that at least one disposable sheet can be withdrawn from the clip, the selectable panel further configured to be selectively folded towards the first dispensing opening to close the first dispensing opening, the cover configured to be pierced and retained of the portion of the removable panel, the cover configured to open the second dispensing opening defining a perforated pattern therein configured for substantially droop-free pop-up dispensing of one disposable sheet at a time.

49. The apparatus as defined in claim 48, wherein the dispensing container and the selectable panel are made of a material selected from the group consisting of cartonboard, cardboard, plastic, polymers, wood, metal, cloth, and ceramic.

50. The apparatus as defined in claim 48, wherein the cover is selected from the group consisting of a polymer, a non-woven polymer, a plastic, a rubber, a tissue, a silk, a cloth, a paper, and a cartonboard.

51. The apparatus as defined in claim 48, wherein the perforated pattern is selected from the group consisting of an X-pattern, a slit pattern, an oval pattern, a wave-pattern, and a circular pattern.

52. The apparatus as defined in claim 48, wherein the perforated pattern is integrally disposed on at least a portion of the selectable panel, the perforated pattern configured for selective piercing before or after the selectable panel is selectively folded away from the first dispensing opening.

53. The apparatus as defined in claim 48, further comprising a hinge apparatus configured to operably attach the selectable panel to the dispensing container for successive operations of the selectable panel.

* * * * *

UNITED STATES PATENT AND TRADEMARK OFFICE

CERTIFICATE OF CORRECTION

PATENT NO. : 6,886,714 B2
DATED : May 3, 2005
INVENTOR(S) : Benjamin J. Kruchoski et al.

It is certified that error appears in the above-identified patent and that said Letters Patent is hereby corrected as shown below:

Title page,
Item [75], Inventors, delete "Nogai" and insert -- Nogaj --.

Signed and Sealed this

Sixteenth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,886,714 B2
APPLICATION NO. : 10/215373
DATED : May 3, 2005
INVENTOR(S) : Kruchoski et al.

It is certified that error appears in the above-identified patent and that said Letters Patent is hereby corrected as shown below:

Col. 9, in Claim 32, lines 28-29, please move the word "and" to appear AFTER the word "cloth".

Signed and Sealed this

Thirty-first Day of October, 2006

JON W. DUDAS
*Director of the United States Patent and Trademark Office*